United States Patent [19]

Poston

[11] Patent Number: 4,996,972

[45] Date of Patent: Mar. 5, 1991

[54] HOT AIR HEAT GUN

[75] Inventor: Terry L. Poston, Virginia Beach, Va.

[73] Assignee: The United States of America as represented by the Secretary of the Navy, Washington, D.C.

[21] Appl. No.: 570,759

[22] Filed: Aug. 22, 1990

Related U.S. Application Data

[63] Continuation-in-part of Ser. No. 425,663, Oct. 23, 1989, abandoned.

[51] Int. Cl.[5] ..... F24J 1/00

[52] U.S. Cl. ..... 126/263

[58] Field of Search ..... 126/263

[56] References Cited

U.S. PATENT DOCUMENTS

| | | | |
|---|---|---|---|
| 3,766,079 | 10/1973 | Jackman et al. | 126/263 |
| 3,804,077 | 4/1974 | Williams | 126/263 |
| 3,811,422 | 5/1974 | Olson | 126/263 |
| 3,924,603 | 12/1975 | Chapin | 126/263 |
| 4,033,323 | 7/1977 | Trumble | 126/263 |
| 4,254,324 | 3/1981 | Vrtaric | 34/98 |
| 4,260,875 | 4/1981 | Walter et al. | 34/98 |
| 4,629,864 | 12/1986 | Wilson | 34/99 |

*Primary Examiner*—Carroll B. Dority

*Attorney, Agent, or Firm*—John D. Lewis; Kenneth E. Walden

[57] ABSTRACT

The invention, in the preferred embodiment, comprises a heat-shrink gun for heat-shrink applications in potentially explosive or flammable conditions, by using a non-electic non-flame producing, and non-sparking heat source. A hand-held housing has a nozzle attached thereto. A heat transfer element is attached within the housing and extends into the nozzle. The space within the nozzle formed between the heat transfer element and the nozzle defines an air heating chamber. A chemically reactive heat cartridge, contained within the heat transfer element, is activated via a striking force. The heat cartridge radiates heat along the heat transfer element into the air heating chamber. Air under pressure is supplied to the air heating chamber and exits the nozzle as hot air under pressure.

8 Claims, 3 Drawing Sheets

FIG. 3b
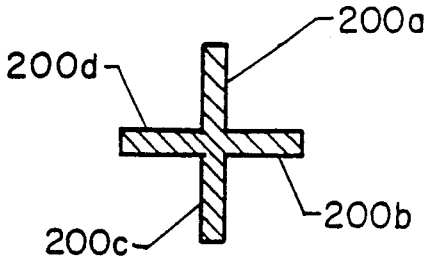
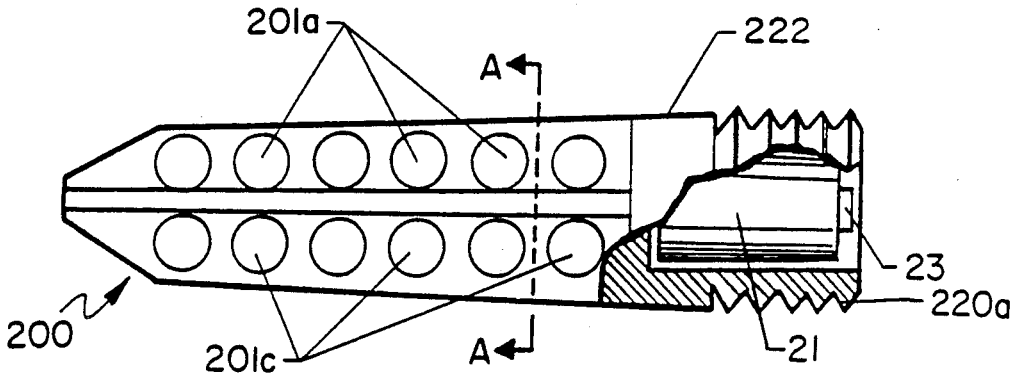
FIG. 3a

HOT AIR HEAT GUN

The following specification is related to the hot air heat gun disclosed in my prior copending application Ser. No. 425,663 filed Oct. 23, 1989, now abandoned, with respect to which the present application is a continuation-in-part.

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to the art of self-contained heating devices and in particular to portable heating devices employing chemical reaction to produce heat.

BACKGROUND OF THE INVENTION

Currently, hand-held heat sources, capable of producing heat at a sufficiently high temperature to activate heat-shrink material, rely on either the combustion of flammable material or electrical power to provide energy for generating the required heat. The use of heat-shrink material to insulate and protect splices in electrical and electronic cables is developed technology. Repairs, using this technology, to electrical and electronic wiring in aircraft are frequently made in areas where no ready source of electrical power of suitable voltage to operate approved heat producing devices is available. Because of the presence of oxygen, fuel and other flammable or explosive equipment, any device used in an aircraft must be constructed so as not to produce any open flame or electrical spark. The use of non-approved electrical heat producing devices is not permissible for reasons of personnel safety as well as possible damage to or destruction of the aircraft. Lack of suitable power at the repair site often precludes the use of approved devices.

The use of combustion heat sources is not acceptable due to the risk of fire or explosion caused by an open flame in a confined space where an explosive atmosphere may exist and the lack of uniformity of heat dispersion. It is particularly desirable to have the heat applied evenly to heat-shrinkable tubing so that the tubing shrinks uniformly around the splice without burning the tubing. While some operators have acquired a high degree of skill in applying the heat from combustion heaters to the surface of heat shrinkable material, with such high localized temperatures heat shrinkable tubing is easily burned thus limiting the effectiveness of the sealing and insulation characteristics of the tubing. No matter how skilled an operator becomes the use of combustion heaters in confined areas where an explosive atmosphere may exist is foolhardy.

SUMMARY OF THE INVENTION

Accordingly, an object of the present invention is to provide a portable device capable of providing sufficient heat to shrink heat-shrinkable tubing.

A further object of the invention is to provide a non-flammable heat source suitable for use in the presence of explosive atmospheres.

Still another object of the invention is to provide a portable hand-held device for generating heat which can be directed to a specific location on a work surface.

In accordance with the present invention, a hand-held device is provided for delivering hot air under pressure. A hand-held housing has a nozzle connected thereto. A heat transfer element is attached within the housing and extends into the nozzle. The space between the heat transfer element and the nozzle forms an air heating chamber. A hermetically sealed, chemically reactive heat cartridge, mounted within the heat transfer element, radiates heat to the heat transfer element when the heat cartridge is activated. Means for activating the heat cartridge are provided within the hand-held housing. Also provided are means for selectively supplying air under pressure to the air heating chamber whereby hot air under pressure exits the nozzle when the heat cartridge is activated.

BRIEF DESCRIPTION OF THE DRAWINGS

FIG. 2(*b*) is an end view of the present invention showing the locking mechanism in the activation position;

FIG. 3(*a*) is a side, cut-away view of an alternative embodiment of a heat transfer element housing a heat cartridge as used in the present invention; and FIG. 3(*b*) is a view along line AA of the heat transfer element of FIG. 3(*a*).

DETAILED DESCRIPTION OF THE INVENTION

Figure 1:
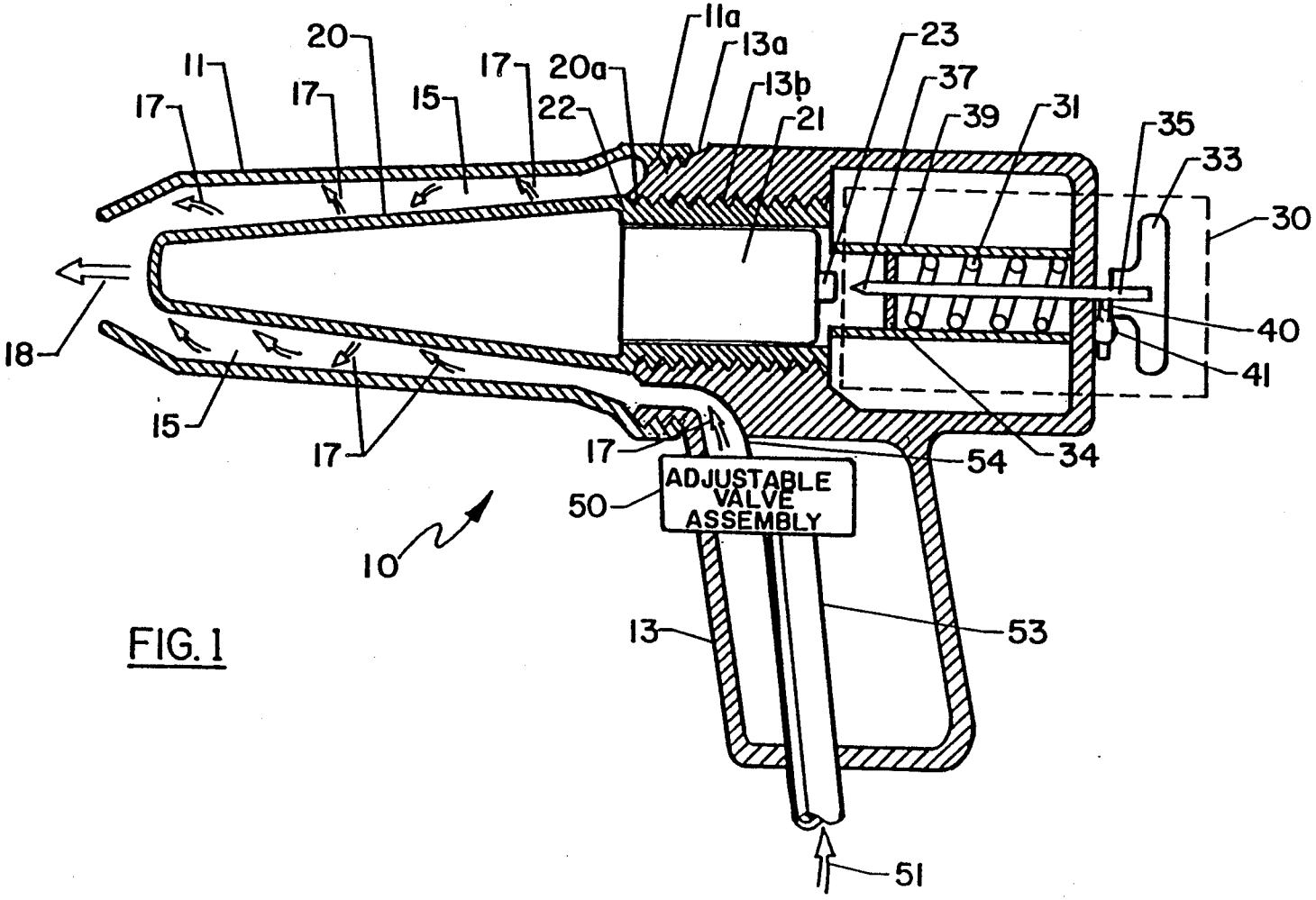
FIG. 1 is a cross-sectional side view of the hot air heat gun according to the present invention.

Referring now to the drawings, and in particular to FIG. 1, a cross-sectional view of a hot air heat gun 10 according to the present invention is shown. A cylindrical nozzle 11 is attached to a hand-held housing 13. Attachment is typically accomplished by a threaded section 11*a* of nozzle 11 in threaded communication with threaded section 13*a* of hand-held housing 13. Of course, attachment and detachment of nozzle 11 to housing 13 may be achieved by any conventional attachment/detachment means. Both nozzle 11 and housing 13 are typically made of heat resistant material in order to facilitate the hand-held feature of the present invention.

Mounted within the housing 13 is a heat transfer element 20 formed of a heat conducting material. For purposes of description only, heat transfer element 20 is shown in a threaded communication with an internal threaded section 13*b* of housing 13. However, the mounting of heat transfer element 20 within housing 13 may be achieved by any conventional mounting means. Heat transfer element 20 extends into nozzle 11. The air space formed between heat transfer element 20 and nozzle 11 defines an air heating chamber 15.

A hermetically-sealed, chemically-reactive heat cartridge 21 is contained within a heat cartridge chamber section 22 of heat transfer element 20. For purposes of activating heat-shrink material, the present invention must be capable of heating air in excess of 800° F. Accordingly heat cartridge 21 is typically a Thermit TM chemical heat cartridge manufactured by Quick Shot, Inc. Once activated, the Thermit TM heat cartridge heats to 848° F. for a 5–7 minute time duration The cartridge is activated via a sufficient striking force applied to an activation head 23 on heat cartridge 21. However, the hot air heat gun 10 of the present invention is not limited to such a heat cartridge. Indeed, any chemically reactive heat cartridge can be used that does not require electrical or spark activation.

As mentioned above, activation of heat cartridge 21 is brought about by a sufficient striking force incident on activation head 23. Such an activation or striking force may be provided by a hammer assembly comprising the elements generally contained within box 30. Hammer assembly 30 consists of a handle 33 attached to a connecting rod 35. Connecting rod 35 passes through the hand-held housing 13 and terminates to form an activation hammer 37. A spring 31 is maintained in a contracted state within housing 13 as spring 31 impinges upon housing 13 on one side of spring 31 and upon a retaining wall 34 fixed to connecting rod 35. Alignment of activation hammer 37 with activation head 23 is accomplished with a cylindrical sleeve 39 encasing that portion of hammer assembly 30 contained within hand-held housing 13. A locking mechanism 40 is provided on the extension of hand-held housing 13 and is shown in greater detail in the end view of FIGS. 2(*a*) and 2(*b*).

Figure 2A:
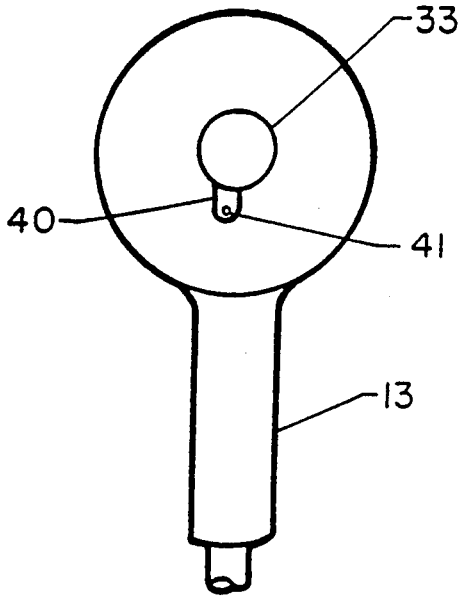
FIG. 2(*a*) is an end view of the present invention showing a locking mechanism in the prevent activation position.
Figure 2B:
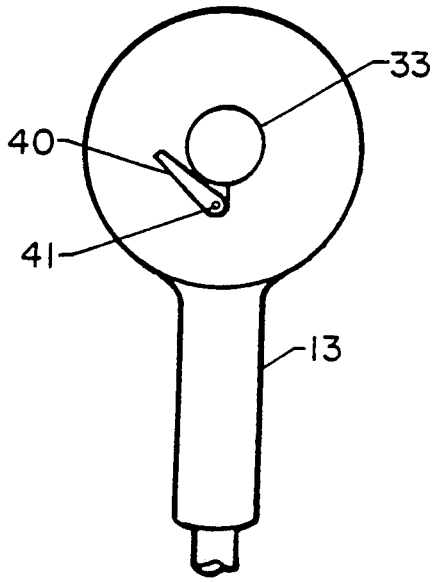

In FIG. 2(*a*), locking mechanism 40 is pivoted about pivot point 41 to prevent handle 33 from coming into contact with hand-held housing 13. Accordingly, spring 31 is prevented from fully imparting its spring force to retaining wall 34 thereby preventing activation hammer 37 from striking activation head 23. As shown in FIG. 2(*b*), locking mechanism 40 is pivoted about pivot point 41 to permit handle 33 to come into contact with housing 13. In this position, the hot air heat gun 10 is in a position permitting operation of heat cartridge 21 by activation hammer 37.

An adjustable valve assembly 50 is provided within handheld housing 13 for regulating the supply of pressurized air entering heating chamber 15 via air tube 54. Adjustable valve assembly 50 receives pressurized air, designated generally by arrow 51, through an inlet tube 53. Pressurized air 51 may be supplied from a number of different external sources such as a standard air compressor, a tank of compressed air or a small battery-driven air compressor. This is merely a design choice and does not constrain the present invention. Adjustable valve assembly 50 may be any conventional means of regulating a pressurized air supply and is not a constraint of the present invention. For the heat-shrink application being described the air flow into heating chamber 15 is typically 2–3 psi.

In operation, a heat cartridge 21 is loaded into heat cartridge chamber section 22 of heat transfer element 20. Heat transfer element 20 and heat cartridge 21 are then mounted into hand-held housing 13 via the mechanical communication between threaded section 20*a* and threaded section 13*b*. Similarly, nozzle 11 is then attached to housing 13 via the mechanical communication between threaded sections 11*a* and threaded section 13*a*.

Locking mechanism 40 is placed in the position to permit activation as shown in FIG. 2(*b*). As handle 33 is pulled and released by an operator, activation hammer 37 strikes activation head 23 thereby initiating chemical reactions within heat cartridge 21. Adjustable valve assembly 50 adjusts the amount of pressurized air 51 that will enter air heating chamber 15 through air tube 54. Adjustable valve assembly 50 is disposed in hand-held housing 13 such that an operator can manually control the amount of air entering air heating chamber 15. Accordingly, adjustable valve assembly 50 can be any conventional manually operated valve assembly The flow of air into and around air heating chamber 15 is designated generally by arrows 17. Hot air under pressure, designated generally by flow arrow 18, then exits nozzle 11.

In an alternative configuration of the present invention, heat transfer element 20 may be a finned heat transfer element 200 as shown in FIGS. 3(*a*) and 3(*b*). FIG. 3(*a*) shows a side cut away view of the alternative heat transfer element 20. For purposes of description only, heat transfer element 200 has 4 fins, 200*a, b, c* and *d* that extend radially outward as shown in the view of FIG. 3(*b*) looking along line AA of FIG. 3(*a*). However, heat transfer element could have any number of fins extending therefrom.

Each of the fins 200*a, b, c* and *d* has a plurality of holes 201*a, b, c* and *d* passing through the respective fins for facilitating air flow 17 throughout heating chamber 15. Just as in the case of heat transfer element 20, finned element 200 has a heat cartridge chamber 222 for housing a heat cartridge 21 and also has a threaded section 220*a* performing the function of threaded section 20*a* in the embodiment of FIG. 1.

Having thus described our invention, it will be understood that the above description of the present invention is susceptible to various modifications, changes and adaptations and that the same are intended to be comprehended within the meaning and range of equivalence of the appended claims. While the present invention was conceived with aircraft maintenance in mind the device will be equally useful in a mine, an underground wire-way or any other confined space where explosive gases may accumulate or a ready source of electrical power may not be available.

What is claimed is:

1. A hand-held device for delivering hot air under pressure comprising:

a hand-held housing;

a nozzle connected to and extending from said housing, said nozzle being detachable from said housing;

a heat transfer element attached within said housing and extending into said nozzle wherein an air heating chamber is formed between said nozzle and said heat transfer element;

a hermetically sealed, chemically reactive heat cartridge contained within said heat transfer element wherein said heat cartridge radiates heat to said heat transfer element when said heat cartridge is activated;

means for activating said heat cartridge, said activating means contained substantially within said hand-held housing; and means for selectively supplying air under pressure to the air heating chamber whereby hot air under pressure exits said nozzle when said heat cartridge is activated.

2. A hand-held device as in claim 1 wherein said heat transfer element comprises:

a heat cartridge chamber for housing said heat cartridge and for conducting heat from said heat cartridge, said heat cartridge housing having threads thereon for mechanical communication with threads within said hand-held housing; and a heat transfer tube attached to and extending from said heat cartridge chamber for conducting heat from said heat cartridge chamber into said nozzle.

3. A hand-held device as in claim 1 wherein said heat transfer element comprises:

a heat cartridge chamber for housing said heat cartridge and for conducting heat from said heat cartridge, said heat cartridge housing having threads thereon for mechanical communication with threads within said hand-held housing; and a plurality of heat conducting fins attached to and extending from said heat cartridge chamber for conducting heat from said heat cartridge chamber into said nozzle, said heat conducting fins further having a plurality of air passageways passing through said fins to facilitate movement of the air under pressure within the air heating chamber.

4. A hand-held device as in claim 1 wherein said heat cartridge contains Thermit TM chemicals.

5. A hand-held device as in claim 4 wherein said activating means comprises:

a spring;

a hammer assembly passing through said hand-held housing and in mechanical communication with said spring within said hand-held housing, said hammer assembly including an activation hammer, wherein said spring imparts a spring force to said activation hammer whereby said activation hammer strikes said heat cartridge for activating same; and means for selectively preventing said activation hammer from striking said heat cartridge.

6. A hand-held device as in claim 1 wherein said selective air supplying means is an adjustable valve assembly contained within said hand-held housing for regulating an amount of air under pressure supplied to the air heating chamber 7. A hand-held device as in claim 1 wherein said hand-held housing comprises heat resistant material.

8. A hand-held device as in claim 1 wherein said nozzle comprises heat resistant material.

* * * * *